United States Patent [19]

Ferrara et al.

[11] 3,941,712

[45] Mar. 2, 1976

[54] SOAP COMPOSITION AND PROCESS OF PRODUCING SUCH

[76] Inventors: Peter J. Ferrara, Ridge Road, Cornwall, N.Y. 12518; Gaston Dalby, St. Germain du Salembre, Neuvic-sur-L'Isle, France; Clarence A. Barnes, Jr., 829 Park Ave., New York, N.Y. 10021; Roy Gordon, 110 E. End Ave., New York, N.Y. 10028

[22] Filed: June 4, 1974

[21] Appl. No.: 476,301

Related U.S. Application Data

[63] Continuation of Ser. No. 216,828, Jan. 10, 1972, Pat. No. 3,814,698.

[52] U.S. Cl. ..... 252/126; 252/108; 252/132; 252/134; 252/368; 252/370; 252/DIG. 5; 252/DIG. 16

[51] Int. Cl.[2]. C11D 9/24; C11D 9/48; C11D 13/10; C11D 13/18

[58] Field of Search ..... 252/108, 112, 114, 118, 252/122, 126, 132, 134, 174, 368, 369, 370, DIG. 16, DIG. 5

[56] References Cited

UNITED STATES PATENTS

| | | | |
|---|---|---|---|
| 243,757 | 7/1881 | Casamajor | 252/126 |
| 273,239 | 2/1883 | Johnston | 252/132 |
| 873,615 | 12/1907 | Samuel | 252/126 |
| 1,836,400 | 12/1931 | Ruppert | 252/127 |
| 2,143,066 | 1/1939 | Hampton | 252/126 |
| 2,724,702 | 11/1955 | Marshall | 252/368 |
| 3,179,596 | 4/1965 | Farrar | 252/125 |

FOREIGN PATENTS OR APPLICATIONS

| | | | |
|---|---|---|---|
| 424,283 | 2/1935 | United Kingdom | 252/122 |
| 1,043,453 | 9/1966 | United Kingdom | 252/122 |

*Primary Examiner*—Dennis L. Albrecht

[57] ABSTRACT

Solid soap such as framed or milled toilet soap, which is conventional in all aspects except that it contains as part of its composition 5 to 100 percent, based upon the weight of free fatty acid components, of at least one "bath oil." The solid soap composition is produced by first saponifying an appropriate fatty acid or mixture thereof in the usual way, solidifying the saponified material by cooling, extruding ribbons of solidified material, drying the extrudate, and then framing the dried extrudate into soap bars. The process hereof differs from this "usual" process in that bath oil, in whatever quantity is desired, is added to the liquid saponification mixture, rather than just prior to the framing step as in the prior art.

6 Claims, No Drawings

SOAP COMPOSITION AND PROCESS OF PRODUCING SUCH

This application is a continuation of application Ser. No. 216,828, filed Jan. 10, 1972, now U.S. Pat. No. 3,814,698.

This invention relates to soap. It more particularly refers to solid soaps, most especially of the milled type.

Milled soaps have been made for many years. It is usual to produce such soaps by liquifying a mixture of fatty acid, or acids, or glycerides thereof, and aqueous sodium hydroxide solution at elevated temperatures; saponifying the fatty acid content of the warm liquid mixture; cooling the saponification mixture to a substantially solid, but suitably soft, condition; forming the solidified saponification mixture into a suitable shape, e.g. by extrusion into a ribbon or the like; drying the shaped extrudate to an acceptable moisture content; milling the dried "soap" with conventional additives and ajuvants such as dyes, pigments, perfumes and the like; and then forming the milled soap composition into bars or other desired shapes.

For many years it has been the desire of the soap industry to incorporate so-called bath oils or the emoluents into milled soap. To date it has only been possible, by presently known processes, to incorporate up to about 1.5 percent, based upon the weight of fatty acid, bath oil in milled soap. The soap industry would like to incorporate orders of magnitude higher proportions of bath oil in milled soap but to date has not been able to.

The known method of incorporating bath oil milled soap is to do so during the above recited milling step. It has been discovered that the problems of the prior art are at this point in the process.

It is therefore an important object of this invention to provide a novel process for incorporating bath oil into milled soap.

It is another object of this invention to provide a milled soap having a much higher proportion of bath oil incorporated therein than prior art soaps.

It is a further object of this invention to utilize as a bath oil in milled soap, a broad spectrum of esters, oils, long chain alcohols, waxes and the like.

It is a further object of this invention to utilize a wide range of ingredient proportions in the manufacture of bar soap containing high proportions of bath oil.

Other and additional objects of this invention will become apparent from a consideration of this entire specification including the claims hereof.

In accord with and fulfilling these objects, one aspect of this invention resides in a novel milled soap, having constituents and proportions thereof conventionally formed in milled soap, which contains a high proportion of bath oil substantially homogeneously incorporated therein. While in the prior art it has been possible to substantially homogeneously incorporate only as much as up to about 1½ weight percent bath oil, there is apparently no upper limit on the proportion of the bath oil which is and can be homogeneously incorporated in the soap of this invention. The proportions of bath oil are not per se critical, although they do define a composition which is distinguished from the prior art. Any proportion of bath oil which exceeds that which the prior art could homogeneously incorporate in milled soap constitutes the lower limit of this proportion in this invention. Suitable lower limits may be 2, 3, 5 or 10 weight percent depending upon what the prior art says it can do. As noted above, as a practical matter milled soaps having 1½ percent bath oil are about as good as have been achieved commercially. As noted above, there is no real upper limit on the proportion of bath oil which can be substantially homogeneously incorporated in milled soap according to this invention. As a practical matter, however, proportions higher than about 150 percent based upon the weight of fatty acid, are not particularly advantageous in that at above these levels the bath oil starts to effect the lathering and cleaning qualities of the soap.

It is to be noted that the term "bath oil" as used herein is intended to represent those materials generally categorized under this heading in the soap and cosmetic arts. Exemplary materials which fall within this group are oils, esters, waxes and long chain alcohols such as isopropyl myristate, palmitate esters, laurate esters, lanolins, castor oils, mineral oils, $C_{12}$ to $C_{15}$ normal alcohols, and ethoxylated long chain linear alcohols of the type exemplified above. The ethoxylation may be with as little as one (1) or as much as five (5) moles of ethylene oxide (or glycol) per alcohol molecule. It should be understood that bath oils are per se known and those materials referred to above are exemplary and non-limiting Tests, to be reported hereinafter, using isopropyl myristate are fully exemplary of this group of materials and the results reported are to be considered as representative of the entire group of water insoluble bath oils.

While the prior art has been generally unable to incorporate large proportions of bath oils into milled soap, this has been accomplished according to this invention by a change in the process of producing milled soap which change, in hindsight, may not appear to be that dramatic. Nevertheless, a most important aspect of this invention is in the process of producing high bath oil containing, substantially homogeneous, milled, solid soap.

As noted above, the prior art has always attempted to incorporate the bath oil during the milling step, which is the point in the processing at which other additives, such as colorants and odorants, are incorporated in the soap. The departure of this invention from the prior art is to incorporate the bath oil into the liquid saponification mixture before it has been solidified and/or dried.

While it is not really known why more bath oil can be homogeneously incorporated in milled soap by the process of this invention than the prior art techniques, it is thought that there may be some connection with the crystal structure of the soap.

The physical structure of soap has been researched by many scientific workers using a variety of techniques. The general conclusion is that soap is a solid solution with a complicated and hard to define lattice structure. By x-ray diffraction studies, electron microscopy and vapor tension data, it is apparent that the lattice structure is capable of physically incorporating or enclosing some molecules of water. It is generally agreed that the absorption of moisture by an over-dried soap flake or granule is exothermic and may produce enough heat to cause spontaneous combustion, particularly when large quantities of dry soap are stored in a confined area. This seems to reinforce the idea that water molecules do in fact become absorbed in the lattices or crystalline structure of the soap in question.

There is also agreement on the physical forms of the soap lattices and this is reflected in the literature accord on the four presently known phases of soap structure, namely, alpha, beta, omega and delta forms. The alpha phase is the least important in that it appears at very low levels in most soaps of commerce. It is believed the alpha phase has the lowest attractive forces for encompassing water, and, as its internal held water readily shifts to another soap phase, usually reduction in alpha phase shows up as an increase in the beta phase. Therefore most solid forms of soap may be considered as consisting of the other three phases. It is possible in producing a soap in solid from to vary the percentages of beta, omega and delta over a considerable range.

In the so-called framed soaps, which are solutions brought to a solidification stage without agitation, the main soap lattice appears as the omega phase. The usual milled soaps are predominantly the beta phase. Milling and plodding result in the dominance of the beta phase. Even the framed soaps will show a shift from omega to beta on applying mechanical work such as milling and plodding. It is also known that in a rapid chilling of a framed soap the omega form will be bypassed and the product will be predominantly in beta form.

One of the interesting phenomenon of the framed soaps (sometimes transparent or translucent types) is the gradual loss of translucency if the corners or edge of a bar of soap are damaged with a sudden force such as by striking the corners against a hard surface. The introduction of even a few crystalline units of beta phase soap by this damaging force seems to result in a gradual conversion of the omega to the beta phase, with a corresponding loss in transparency values. A parallel case of beta crystals invading the province of the omega may be observed by making a composite bar by hydraulic pressing together the smooth faces of a frame soap and an ordinary milled soap. The rate of crystalline invasion will vary with a number of factors including moisture content, ingredients, hardness, etc. . . . though a period lapse of 6–8 weeks is usually enough to reflect the shift in crystallinity of the beta phase in the framed portion of the composite bar.

The delta form appears to an intermediate between beta and omega in terms of water solubility and lather capacity and also in terms of hardness.

The main physical attributes of beta, omega and delta forms to a soap maker appear in the reaction of these forms when soaked in water. The beta form soap tends to absorb water readily as evidenced by swelling and its tendency to disintegrate. The omega phase is the least water soluble form, in terms of its response to water soaking, and gives practically no evidence of swelling. The delta phase has reactivity constants between beta and omega phases, with a tendency to form cracks or fissures with only a slight swelling.

Manufacturers of milled soaps have made numerous unsuccessful attempts to mill into the crystalline lattices of the usual soaps, a variety of water insoluble oils and esters, generally referred to as bath oils. The objective has been to incorporate into milled soaps enough bath oil substance to achieve a simultaneous soap bathing effect, and the covering of the body with a protective film of bath oil. The usual techniques require the production of soaps. and reducing the soaps to flakes, ribbons or chips to simplify the drying out to moisture levels between 5 and 12 percent. On reaching these levels of moisture, the flakes are put through milling rolls to incorporate ingredients such as pigments, opacifiers, fragrances and different colors. At this stage, an attempt is made to incorporate various and sundry bath oils. The inclusion of bath oils by these classic methods has been limited to levels of 1 – 1.5 percent of weight of the soap. Additions in excess of 1.5 percent produced soaps that were soft and somewhat oily, with poor lathering ability. In terms of the soap tendency to disintegrate, it seemed obvious that the soap lattice had all the characteristics of the beta phase. This phase appears to resist the absorption of oils irrespective of moisture levels.

There has now been discovered a technique which enables the incorporation of relatively large percentages of bath oils, yet produces a milled soap with the desired physical properties and eminently suitable properties of bathing and laying on bath oils. By the use of our technique, bath oil additions measuring up to 100 percent or more, based on the free fatty acid content, can be achieved. Such elevated levels are set forth merely to emphasize the extent to which the same ingredient compositions are compatible with very high levels of bath oils.

The very core of this invention is the discovery that if the bath oils are incorporated after the saponification step but prior to the formation of the crystalline phases such as those previously reviewed, then the crystalline phases which forms are predominantly the omega phases. The omega phase appears to have large and unexpected tolerance for bath oils. Not only does the omega phase have an unexpectedly high absorption capacity for bath oils, e.g. mineral oils, esters, alcohols, etc. but the omega crystalline lattice appears to be capable of withstanding a considerable amount of milling and plodding without the exudation or loss of oil, or diversion from the omega state.

The moisture content of the high oil soaps made by the procedure set forth in the preceding paragraphs may be reduced to levels of 5 – 12 percent as preferred, by drying out soap noodles, flakes or ribbons through the conventional warm air heating type of apparatus.

Whether or not the theory, that the addition of bath oils right after saponification but prior to solidification is truly a matter of maintaining the soap lattices in the omega phase, is an exact representation of what takes place, may or may not be easily proven. The following examples and references however tend to support the omega phase theory or concept as an acceptable view.

One series of experiments serve to illustrate how the sequential process of putting the ingredients together produce soaps having the same composition chemically, but with surprisingly different properties. The variations in properties is thus a striking view of the effects of the particular crystalline lattices of the soap.

A batch of soap noodles was prepared by saponifying equal molar quantities of stearic acid and lauric acid with a stoichiometric equivalent of sodium hydroxide dissolved in a water solution. The ratios were 284 grams of stearic acid, 200 grams of lauric acid and 80 of sodium hydroxide (2 mols) in 160 ml. of water — 29 grams of glycerine were added to the molten fatty acids. The saponification was conducted at a temperature range of 190°–200° F. The hot mixture was transferred to trays and cooled until well solidified, then extruded into ribbons for drying. The ribbons were dried to a moisture level of 10 percent. These ribbons were processed in the normal manner of soap making and produced firm bars with excellent sheen and superior lather and detergent effects.

Using the prepared ribbons of the preceding paragraph, we go to the first of our three experiments:

EXAMPLE 1

In this Example, 2000 grams of the dried flakes were mixed with 844 grams of isopropyl myristate and recycled through a mixing screw and pressed through a plodder. The myristate was added in increments, and the product was recycled until the ester was completely taken up. Bars of soap made from the soap base plus myristate by this method were soft with an oily feel. When placed in water, the bars tended to disintegrate. The lathering capacity of the soap bars was retarded, and the detergency of the bars was less than satisfactory.

The bars of soap thus produced failed to improve on standing even as long as 6 months.

EXAMPLE 2

In this Example the same ribbons used in producing the base for the previous experiment, were handled in a different manner. The 2000 grams of soap ribbons and the 844 grams of isopropyl myristate were mixed together in a kettle and the mixture brought to a temperature of 240° F. At this temperature, the mix resembled the consistency of soft, mashed potatoes. The kettle was emptied and the contents placed on trays to solidify. The solidified mass was then processed into bars of soap in accordance with the same steps followed in EXAMPLE 1. The bars of soap made according to this procedure were firmer than those made in the previous example, yet lacking in a full measure of the desired properties sought in a quality toilet soap.

EXAMPLE 3

In this Example, we will describe the formulation of an "in situ" soap composition, having the same proportion of ingredients as in the previous Examples 1 and 2.

We combined 568 grams of stearic acid and 400 grams of lauric acid. These were melted in a kettle along with 65 grams of glycerine. A sodium hydroxide solution containing 160 grams of alkali in 320 ml. of water was also prepared. The molten fatty acid and glycerine were brought to a temperature of 190° F and the alkali added with vigorous agitation. When the saponification ingredients had been thoroughly mixed, 350 grams of isopropyl myristate was added (this corresponds to the 844 grams used per 2000 grams. in the previous Examples). Mixing was continued until the liquid phase of myristate had been incorporated in the saponification mixture.

The mash-potato like mixture was removed to trays and cooled. When cool, it was extruded into ribbons and dried to a moisture level of 10 percent.

Bars of soap made from a composition processed in the manner just described are outstandingly different from those covered in the prior Examples 1 and 2. The bars were firm, lathered well and produced a combination of detergency and residual oil feed that was notable. It is apparent therefore that this technology of producing a bath oil soap bar results in a combination of ingredients, and crystalline structure of superior characteristics.

These Examples were repeated with a number of bath oil ingredients as substitutes for the isopropyl myristate. These substitutions included palmitate and laurate esters, lanolins, castor oils, mineral oils, and a number of linear primary alcohols ranging in chain length from C-12 to C-15. Some of the linear alcohols were ethoxylated with various degrees of ethylene oxide substitution. In all cases, the same kind of differentiation as brought out in the 3 Examples was evident.

As a matter of indicating the extreme capacity of a soap base to absorb bath oils, tests were made where the ratio of bath oils to fatty acids were as high as 1.5 to 1.0. While these high ratios may be impractical from the standpoint of a commercially saleable bar because of economics, it is evident that the technology set forth herein is applicable to many soap formulations.

What is claimed is:

1. In the process of producing solid, milled bar soap comprising:

A. heating a mixture of soap making ingredients comprising soap producing fatty acids, fatty acid glycerides or mixtures thereof and a saponifying proportion of alkali to an elevated saponifying temperature sufficient to form a hot liquid mixture of soap and water;

B. cooling said hot liquid mixture thereby solidfying such;

C. drying said mixture; and then

D. forming said dried solid mixture into solid bar soap by a process comprising milling, plodding and extruding; the improvement, whereby producing solid, milled bar soap containing about 5 to 100 weight percent, based upon the fatty acid content of said soap, of mineral oil, which comprises:

adding to said hot liquid mixture of soap and water produced by step A a substantially water insoluble additive comprising mineral oil whereby forming a homogeneous, hot liquid mixture comprising said soap, water and about 5 to 100 weight precent, based upon the fatty acid content of said soap, of said mineral oil; and subjecting said homogeneous, hot liquid mixture to steps B, C and D as aforesaid.

2. The process claimed in claim 1 wherein said additive is an emollient mixture containing said mineral oil.

3. The process claimed in claim 1 wherein said mineral oil is present in a proportion of about 5 to 50 weight percent based on the fatty acid content of said soap.

4. the process claimed in claim 2 wherein said emollient consists essentially of mineral oil.

5. The process claimed in claim 1 wherein the heating of step A is to about 190° to 200° F and the mixture is dried to a moisture content of 5 to 12 percent in step C.

6. A substantially homogeneous solid milled bar soap produced by the process of claim 1.

* * * * *

Disclaimer 3,941,712.—*Peter J. Ferrara*, Cornwall, N.Y., *Gaston Dalby*, St. Germain du Salembre, Neuvic-sur-L'Isle, France, *Clarence A. Barnes, Jr.*, New York, and *Roy Gordon*, New York, N.Y. SOAP COMPOSITION AND PROCESS OF PRODUCING SUCH. Patent dated Mar. 2, 1976. Disclaimer filed Sept. 29, 1975, by the inventors.

Hereby enter this disclaimer to all claims of said patent.

[*Official Gazette May 4, 1976.*]